US010279374B1

(12) United States Patent
Magaro

(10) Patent No.: US 10,279,374 B1
(45) Date of Patent: May 7, 2019

(54) METHODS AND COMPOSITIONS FOR RESURFACING WOODEN SURFACES

(76) Inventor: Anthony Magaro, Camp Hill, PA (US)

( * ) Notice: Subject to any disclaimer, the term of this patent is extended or adjusted under 35 U.S.C. 154(b) by 0 days.

(21) Appl. No.: 13/566,589

(22) Filed: Aug. 3, 2012

Related U.S. Application Data

(60) Provisional application No. 61/515,010, filed on Aug. 4, 2011.

(51) Int. Cl.
*B05D 5/04* (2006.01)
*B05D 5/00* (2006.01)

(52) U.S. Cl.
CPC ..... *B05D 5/005* (2013.01); *B05D 5/04* (2013.01)

(58) Field of Classification Search
USPC ..... 427/140; 134/29, 38
See application file for complete search history.

(56) References Cited

U.S. PATENT DOCUMENTS 3,955,999 A * 5/1976 Snellgrove ..... 106/245
4,317,755 A * 3/1982 Gregory ..... C09G 1/10 106/10
4,830,772 A * 5/1989 Van De Mark ..... C09D 9/005 134/38
5,258,063 A * 11/1993 Cifuentes et al. ..... 106/3
5,709,589 A * 1/1998 Boone ..... A47L 11/00 451/353
6,929,702 B1 * 8/2005 Motsenbocker ..... C11D 3/43 134/40

FOREIGN PATENT DOCUMENTS

WO WO 2011043728 A1 * 4/2011

* cited by examiner

*Primary Examiner* — Dah-Wei D. Yuan
*Assistant Examiner* — Inga Leung V Law
(74) *Attorney, Agent, or Firm* — Duane Morris LLP

(57) ABSTRACT

Provided herein are compositions and methods that relate to resurfacing and refinishing. The compositions comprise an aqueous detergent and VM & P naphtha. The methods can be applied to a variety of wooden surfaces including floors, fixtures, furniture and cabinetry.

16 Claims, 15 Drawing Sheets

Before & After Shots

Before & After Shots

Before & After Shots

Before & After Shots

Before & After Shots

Before & After Shots

Before & After Shots:
Furniture

Before & After Shots

Before & After Shots

The Process: Step 1, Cleaning

The Process: Step 2, Finishing

Hand Held Scrubber

Swing Buffer Outfitted with Chemical Reservoir, Skirt and Light

Maroon Pad and Microfiber Combo

METHODS AND COMPOSITIONS FOR RESURFACING WOODEN SURFACES

CROSS-REFERENCE TO RELATED APPLICATIONS

This application claims priority under 35 U.S.C. § 119(e) from Provisional Application Ser. No. 61/515,010, filed Aug. 4, 2012.

FIELD OF THE INVENTION

The present invention generally relates to methods and compositions for resurfacing and refinishing wooden surfaces.

SUMMARY OF THE INVENTION

Disclosed herein are methods and compositions for refinishing a wooden surface. The method includes applying a composition comprising an aqueous detergent solution and varnish makers' and painters' (VM & P) naphtha to the surface; and sanding the surface; and, optionally, removing the composition from the surface.

DETAILED DESCRIPTION

Figure 1B:
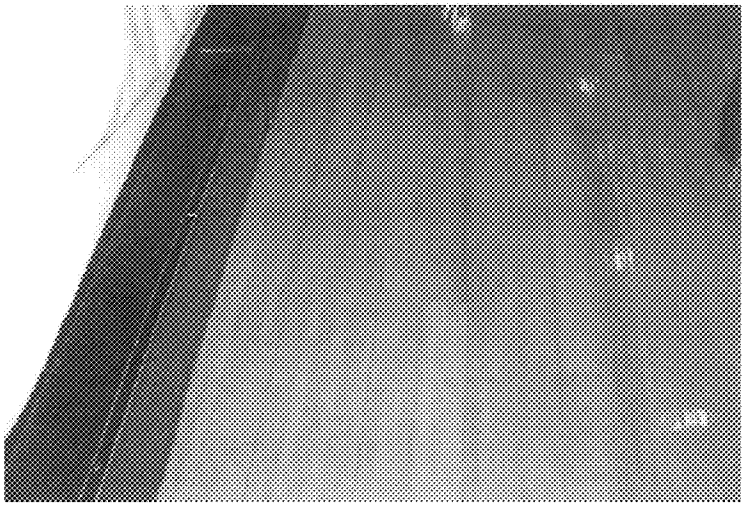
FIG. 1*b* illustrates the floor in FIG. 1*a* after treatment with the methods of invention.

This description of preferred embodiments is intended to be read in connection with the accompanying drawings, which are to be considered part of the entire written description. The drawing figures are not necessarily to scale and certain features of the invention may be shown exaggerated in scale or in somewhat schematic form in the interest of clarity and conciseness. In the description, relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral," and the like are to be interpreted relative to one another or relative to an axis of elongation, or an axis or center of rotation, as appropriate. Terms concerning attachments, coupling, and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Unless otherwise stated, all percentages, parts, ratios, or the like are by weight. When an amount, concentration, or other value or parameter is given as either a range, preferred range, or a list of upper preferable values and lower preferable values, this is understood as specifically disclosing all ranges formed from any pair of any upper range limit or preferred value and any lower range limit or preferred value regardless of whether those ranges are explicitly disclosed.

The present invention provides methods and materials for resurfacing, restoring and refinishing wooden surfaces. The inventor has found that application of formulation comprising a mixture of an aqueous detergent solution and varnish makers' and painters' (VM & P) naphtha in combination with abrasive scrubbing and sanding results in a surface that is immediately ready for finishing, for example, with a polyurethane solution. The methods of the invention allow for rapid, efficient refinishing of surfaces and at the same time eliminate the need for more invasive procedures, such as drum sanding, which can potentially damage wooden surfaces. The methods of the invention also provide simple and effective means of stain removal, particularly stains that result from contact with biological fluids, such as urine.

Compositions

The compositions of the invention comprise an aqueous detergent solution and varnish makers' and painters' (VM & P) naphtha. We may refer to the aqueous detergent solution and varnish makers' and painters' (VM & P) naphtha as ingredient A and ingredient B, respectively. A detergent can be surfactant or mixture of surfactants having solubilizing or cleaning properties. Any aqueous detergent solution can be used as long as the resulting mixture of detergent solution and VM & P naphtha retains the ability to remove the existing finish. The detergent can be an anionic detergent (e.g., an alkylbenzenesulfonate, sodium lauryl sulfate and Na n-dodecylbenzenesulfonate); a cationic detergent, e.g., a group of detergents that have molecules containing a quaternary ammonium salt cation with a group of 12 to 24 carbon atoms attached to the nitrogen atom in the cation (e.g., trimethylhexdecylammonium chloride, didecyl dimethyl ammonium chloride, n-alkyl dimethyl benzyl ammonium chloride); an ethoxylate; or a non-ionic (or zwitterionic) detergent (e.g., polyoxyethylene glycol (i.e., Tween, Triton and Brij series), CHAPS, glycosides (i.e. octyl-thioglucoside, maltosides), bile acids such as deoxycholic acid (DOC), lipids (HEGAs), or phosphine oxides. In some embodiments, the detergent can include or exclude one or more of an anionic detergent (e.g., an alkylbenzenesulfonate, sodium lauryl sulfate and Na n-dodecylbenzenesulfonate); a cationic detergent, e.g., a group of detergents that have molecules containing a quaternary ammonium salt cation with a group of 12 to 24 carbon atoms attached to the nitrogen atom in the cation (e.g., trimethylhexdecylammonium chloride, didecyl dimethyl ammonium chloride, n-alkyl dimethyl benzyl ammonium chloride); an ethoxylate; or a non-ionic (or zwitterionic) detergent (e.g., polyoxyethylene glycol (i.e., Tween, Triton and Brij series), CHAPS, glycosides (i.e. octyl-thioglucoside, maltosides), bile acids such as deoxycholic acid (DOC), lipids (HEGAs), or phosphine oxides. In some embodiments, the detergent is biodegradable. In some embodiments, the detergent can include two or more of an anionic detergent (e.g., an alkylbenzenesulfonate, sodium lauryl sulfate and Na n-dodecylbenzenesulfonate); a cationic detergent, e.g., a group of detergents that have molecules containing a quaternary ammonium salt cation with a group of 12 to 24 carbon atoms attached to the nitrogen atom in the cation (e.g., trimethylhexdecylammonium chloride, didecyl dimethyl ammonium chloride, n-alkyl dimethyl benzyl ammonium chloride); an ethoxylate; or a non-ionic (or zwitterionic) detergent (e.g., polyoxyethylene glycol (i.e., Tween, Triton and Brij series), CHAPS, glycosides (i.e. octyl-thioglucoside, maltosides), bile acids such as deoxycholic acid (DOC), lipids (HEGAs), or phosphine oxides. Examples of other surfactants are described in *McCutcheon's Vol. 1: Emulsifiers and Detergents*, North American Ed., McCutcheon Division, MC Publishing Co., 2002, which is herein incorporated by reference.

In some embodiments, the detergent can include or exclude a glycol ether, i.e., an alkyl ether of ethylene glycol. A useful glycol ether is 2-ethoxyethanol (also known as ethylene glycol ethyl ether, Cellosolve, ethyl cellosolve or oxitol). Other exemplary glycol ethers include ethylene glycol monomethyl ether (2-methoxyethanol) ethylene glycol monoethyl ether (2-ethoxyethanol) ethylene glycol monopropyl ether (2-propoxyethanol), ethylene glycol monoisopropyl ether (2-isopropoxyethanol), ethylene glycol monobutyl ether (2-butoxyethanol) ethylene glycol monophenyl ether (2-phenoxyethanol), ethylene glycol monobenzyl ether (2-benzyloxyethanol), diethylene glycol monomethyl ether (2-(2-methoxyethoxy)ethanol, (also known as methyl carbitol) diethylene glycol monoethyl ether (2-(2-ethoxyethoxy)ethanol, (also known as carbitol cellosolve), and diethylene glycol mono-n-butyl ether (2-(2-butoxyethoxy)ethanol).

In some embodiments the detergent can include or exclude a propylene-based glycol ether, e.g. an ether of propylene glycol. Useful propylene glycol ethers include propylene glycol n-butyl ether (also known as CAS No. 5131-66-8 (major isomer), 1-butoxypropan-2-ol, 1-butoxy-2-propanol, PnB, propylene glycol normal-butyl ether, 1-butoxy-2-propanol and DOWANOL™ PnB glycol ether), dipropylene glycol normal butyl ether, (mono) propylene glycol (mono) ethyl ether, dipropylene glycol (mono) methyl ether, (mono) propylene glycol (mono) methyl ether acetate, (mono) propylene glycol normal propyl ether, tripropylene glycol normal butyl ether, dipropylene glycol (mono) methyl ether acetate, (mono) propylene glycol normal propylene ether and (dipropylene glycol normal ether), propylene glycol (mono) methyl ether, (mono) propylene glycol normal butyl ether, and tripropylene glycol (mono) methyl ether.

In some embodiments the detergent can include two or more of an alkyl ether of ethylene (for example, glycol 2-ethoxyethanol (also known as ethylene glycol ethyl ether, Cellosolve, ethyl cellosolve or oxitol). Other exemplary glycol ethers include ethylene glycol monomethyl ether (2-methoxyethanol) ethylene glycol monoethyl ether (2-ethoxyethanol) ethylene glycol monopropyl ether (2-propoxyethanol), ethylene glycol monoisopropyl ether (2-isopropoxyethanol), ethylene glycol monobutyl ether (2-butoxyethanol) ethylene glycol monophenyl ether (2-phenoxyethanol), ethylene glycol monobenzyl ether (2-benzyloxyethanol), diethylene glycol monomethyl ether (2-(2-methoxyethoxy)ethanol, (also known as methyl carbitol) diethylene glycol monoethyl ether (2-(2-ethoxyethoxy) ethanol, (also known as carbitol cellosolve), and diethylene glycol mono-n-butyl ether (2-(2-butoxyethoxy)ethanol) or two or more of an ether of propylene glycol (for example, glycol n-butyl ether (also known as CAS No. 5131-66-8 (major isomer), 1-butoxypropan-2-ol, 1-butoxy-2-propanol, PnB, propylene glycol normal-butyl ether, 1-butoxy-2-propanol and DOWANOL™ PnB glycol ether), dipropylene glycol normal butyl ether, (mono) propylene glycol (mono) ethyl ether, dipropylene glycol (mono) methyl ether, (mono) propylene glycol (mono) methyl ether acetate, (mono) propylene glycol normal propyl ether, tripropylene glycol normal butyl ether, dipropylene glycol (mono) methyl ether acetate, (mono) propylene glycol normal propylene ether and (dipropylene glycol normal ether), propylene glycol (mono) methyl ether, (mono) propylene glycol normal butyl ether, and tripropylene glycol (mono) methyl ether.)

In some embodiments, the detergent can include a mixture of one or more of an alkyl ether of ethylene glycol (for example, glycol 2-ethoxyethanol (also known as ethylene glycol ethyl ether, Cellosolve, ethyl cellosolve or oxitol). Other exemplary glycol ethers include ethylene glycol monomethyl ether (2-methoxyethanol) ethylene glycol monoethyl ether (2-ethoxyethanol) ethylene glycol monopropyl ether (2-propoxyethanol), ethylene glycol monoisopropyl ether (2-isopropoxyethanol), ethylene glycol monobutyl ether (2-butoxyethanol) ethylene glycol monophenyl ether (2-phenoxyethanol), ethylene glycol monobenzyl ether (2-benzyloxyethanol), diethylene glycol monomethyl ether (2-(2-methoxyethoxy)ethanol, (also known as methyl carbitol) diethylene glycol monoethyl ether (2-(2-ethoxyethoxy)ethanol, (also known as carbitol cellosolve), and diethylene glycol mono-n-butyl ether (2-(2-butoxyethoxy)ethanol) and one or more of an ether of propylene glycol (for example, glycol n-butyl ether (also known as CAS No. 5131-66-8 (major isomer), 1-butoxypropan-2-ol, 1-butoxy-2-propanol, PnB, propylene glycol normal-butyl ether, 1-butoxy-2-propanol and DOWANOL™ PnB glycol ether), dipropylene glycol normal butyl ether, (mono) propylene glycol (mono) ethyl ether, dipropylene glycol (mono) methyl ether, (mono) propylene glycol (mono) methyl ether acetate, (mono) propylene glycol normal propyl ether, tripropylene glycol normal butyl ether, dipropylene glycol (mono) methyl ether acetate, (mono) propylene glycol normal propylene ether and (dipropylene glycol normal ether), propylene glycol (mono) methyl ether, (mono) propylene glycol normal butyl ether, and tripropylene glycol (mono) methyl ether.)

The detergent solution may also include optional ingredients, for example, wetting agents, emulsifiers, builders, chelants, polymers, buffers, bactericides, preservatives, solvents, hydrotropes, colorants, stabilisers, radical scavengers, bleaches, bleach activators, enzymes, soil suspenders, dye transfer agents, brighteners, anti-dusting agents, dispersants, dye transfer inhibitors, pigments, silicones, perfumes and/or dyes. In some embodiments, the detergent solution may exclude wetting agents, emulsifiers, builders, chelants, polymers, buffers, bactericides, preservatives, solvents, hydrotropes, colorants, stabilisers, radical scavengers, bleaches, bleach activators, enzymes, soil suspenders, dye transfer agents, brighteners, anti-dusting agents, dispersants, dye transfer inhibitors, pigments, silicones, perfumes and/or dyes. In some embodiments, the detergent solution can include a combination of one, two, three, four, five, six, seven, eight, nine or ten or more of the optional ingredients listed above.

In some embodiments, a commercially available detergent solution can be used. Exemplary detergent solutions include Krud Kutter® (Supreme Chemicals of Georgia, Cumming Ga.), Krud Kutter Gloss-Off® (Supreme Chemicals of Georgia, Cumming Ga.), Sanifil Rub Out or Sanifil Co-jet (Bortek Industries, Mechanicsburg Pa.).

The concentration of detergent in the aqueous detergent solution can vary depending of a variety of factors, including, for example, the chemical structure of the detergent, the presence of optional ingredients and the pH of the solution. Exemplary concentrations include from about 1% to about 40%, e.g., about 1%, about 2%, about 3%, about 4%, about 5%, about 6%, about 7%, about 8%, about 9%, about 10%, about 12%, about 15%, about 18%, about 20%, about 25%, about 30%, about 35%, or about 40%. The aqueous detergent solution can be prepared in a more concentrated form and then diluted for use. Suitable concentrations for use include, for example, from about 0.5% to about 20% e.g., about 0.5% about 1%, about 2%, about 3%, about 4%, about 5%, about 6%, about 7%, about 8%, about 9%, about 10%, about 12%, about 15%, about 18%, or about 20%.

In some embodiments, the compositions can include or exclude a caustic agent, for example, a base or an acid. Exemplary bases include NaOH, KOH. Exemplary acids include acetic acid, ascorbic acid, boric acid, carbonic acid, citric acid, hydrochloric acid, lactic acid, phosphoric acid, sulfuric acid, tannic acid and trichloroacetic acid. Any combination of two or more bases or two or more acids can also be used. In some embodiments, the compositions can include or exclude a chelating agent, for example ethylene diamine tetraacetic acid (EDTA), citric acid, or a phosphonate. In some embodiments, the compositions can include or exclude an oxidizing agent, for example, a peroxide, e.g., $H_2O_2$ The compositions of the invention also include varnish makers' and painters' (VM & P) naphtha (also known as petroleum ether, petroleum spirit, refined solvent naphtha, ligroin, benzine, petroleum naphtha, naphtha ATSM, petroleum ether of varying boiling point ranges from 20 to 75° C. (68-167° F.). In some embodiments, the VM & P naphtha can have a boiling point range of 256-288° F. VM & P naphtha can be obtained from any commercial source, for example EKI (Joliet, Ill.).

The relative proportions of the aqueous detergent and the VM &P naphtha in the compositions of the invention can vary depending upon many factors including the composition of surface to which the solution is to be applied, extent of wear on the surface and the presence of any stains on the surface. The aqueous detergent and the VM &P naphtha can be combined in proportions of about 20:1 to about 0.5:1, for example 15:1, 10:1, 5:1, 3:1, 2:1 or 1:1. For general use on floors, the proportions can be about 10:1. For removal of stains from biological fluids, for example, urine stains, useful proportions can be about 1:1. In some embodiments, the aqueous detergent and the VM &P naphtha can be diluted, for example, with water or other aqueous-based solvents, before they are combined. Alternatively, or in addition, the aqueous detergent and the VM &P naphtha can be combined to form a mixture and the mixture can be diluted with water or other aqueous-based solvents before they are used. The aqueous detergent and the VM &P naphtha can be combined and stored, for example, for days, weeks or months before use or they can be combined and used directly.

The compositions of the invention can also include or exclude a wax. i.e., an organic compound that includes long alkyl chains. The addition of wax is useful for cleaning raw wood without raising the wood grain or leaving grey water marks. The addition of wax also reduces the number of coatings necessary. Natural waxes typically include esters of fatty acids and long chain alcohols. Synthetic waxes are long-chain hydrocarbons that lack functional groups. Exemplary waxes include animal waxes, for example, beeswax; vegetable waxes, for example, carnauba wax; mineral waxes; petroleum waxes, for example, paraffin wax, microcrystalline wax, petroleum jelly; synthetic waxes, for example, polyethylene waxes, Fischer-Tropsch waxes, chemically modified waxes, substituted amide waxes and polymerized α-olefins.

The wax can be a wax, e.g., a paste wax, that has been liquefied by mixing it with a solvent, such a paint thinner. Exemplary solvents include mineral spirits, acetone, mineral turpentine, true turpentine, naphtha, white spirit, methyl ethyl ketone, dimethylformamide, 2-butoxyethanol, a glycol ether, ethylbenzene, xylene, n-butyl acetate, butan-1-ol, diacetone alcohol, medium aliphatic hydrocarbon solvents, light aromatic hydrocarbons, and 1, 2, 4 trimethylbenzene. Alternatively, or in addition, the wax can be a liquid wax obtained from commercial sources, for example, Minwax DuraSeal®.

The relative proportions of the aqueous detergent/VM &P naphtha mixture and the wax in the compositions of the invention can vary depending upon many factors including the composition of surface to which the solution is to be applied, extent of wear on the surface and the presence of any stains on the surface. The aqueous detergent/VM &P naphtha and the wax can be combined in proportions of about 1:1 to about 1:50, for example 1:1; 1:2, 1:3, 1:4; 1:5; 1:6; 1:7; 1:8; 1:9; 1:10, 1:12; 1:15; 1:18; 1:20; 1:30; 1:40; or 1:50. For general use on floors, the proportions can be about 1:1. The aqueous detergent and the VM &P naphtha can be combined and stored, for example, for days, weeks or months before use or they can be combined and used directly.

Methods

The methods of the invention are useful for resurfacing, restoring and refinishing wooden surfaces. The methods can be used on any surface in need of refinishing. Such surfaces can include surfaces that have become discolored by aging of previously applied urethanes, waxes or varnishes, worn due to water and dirt, i.e., "greyout" or worn due to heavy use, e.g., wear or loss of existing floor finishes and surfaces due to heavy foot traffic. In some embodiments, the compositions and methods may be used on non-wooden surfaces, for example, on metal, vinyl, or concrete.

The methods of the invention can be used to refinish any wooden surface. An aqueous detergent solution and VM & P naphtha are combined to form a mixture and applied to the surface in need of restoration. In some embodiments, the aqueous detergent solution/VM & P naphtha mixture can be combined with a wax. The surface is sanded in the presence of the mixture. In some embodiments, the application step and the sanding step are performed simultaneously. In some embodiments, the mixture is removed following the sanding step. Once the sanding step is completed, a coating is applied to the sanded surface.

The application methods, sanding techniques, removal steps, coating methods and compositions will vary according to the location and composition of the surface, the existing finish on the surface, the extent of wear and other damage to the surface, and the kind of coating to be applied to the surface.

Figure 14:
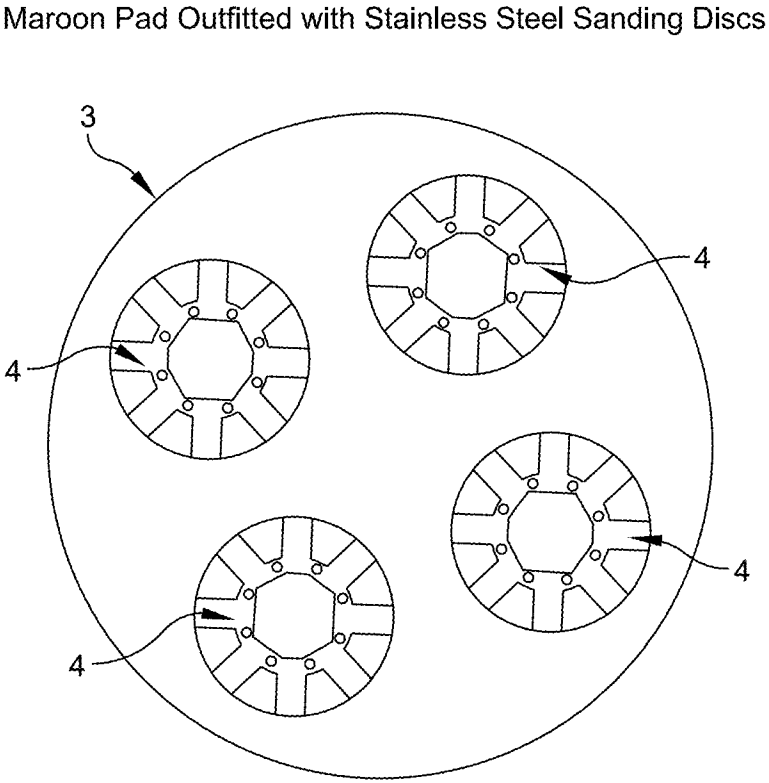
FIG. 14 illustrates a maroon pad outfitted with stainless steel sanding discs.
Figure 15:
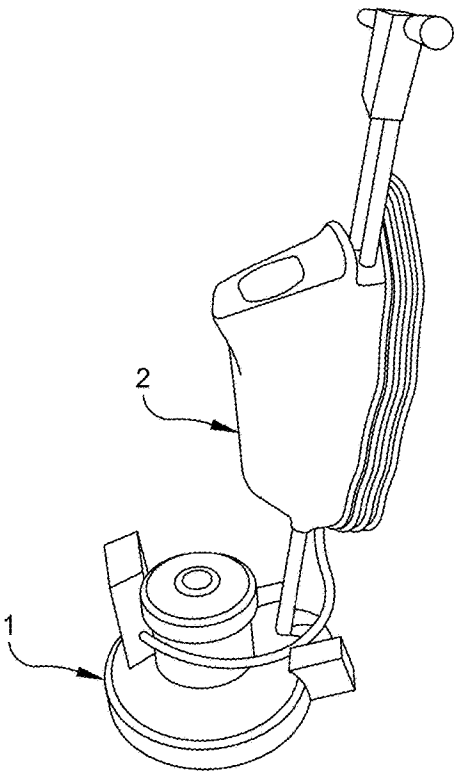
FIG. 15 illustrates a swing buffer outfitted with chemical reservoir, skirt and light.

The compositions can be applied to floors using a floor buffer. In one embodiment, a 17-inch swing buffer, preferably a 1.5 horsepower, 180 RPM, 135-pound unit outfitted with a chemical reservoir and a gravity-fed release fluid system valve is employed. A skirt is outfitted around the bottom to contain the liquid and sanding discs. (We may also refer to sanding discs as sanding screens.) A standard buffer driver is used to hold the pads and sanding screens. FIG. 15 illustrates a swing buffer (1) with a chemical reservoir (2). FIG. 14 illustrates a 16-inch maroon scrubbing pad (3) equipped with stainless steel sanding discs (4). In some embodiments, a cordless four-headed battery powered scrubber can be used.

Regardless of the particular method used, NOFMA and OSHA guidelines for safety protection should be followed. In some embodiments, such safety equipment can include full face gear and mid-arm rubber gloves.

In one embodiment, a 10-1 mixture of the aqueous detergent solution and the VM & P naphtha is funneled into a five-gallon plastic container. From the five-gallon container, approximately 20 ounces of fluid are poured into the reservoir. The amount of solution needed can vary depending upon the condition of the floor, but in general, about one ounce to about 10 ounces of solution is suitable for ten square feet of flooring. Thus, about 10 to about 100 ounces of solution are suitable for 100 square feet. In one embodiment, two ounces of the solution are applied to approximately ten square feet of flooring.

The degree of wear on the floor will determine, in part, the specific equipment and techniques that are used. Floors with minor wear include floors that have never been refinished, floors that show no visible wear or distress, but that have an aging, soiled finish or thin "wavy" floors. Floors with medium wear include floors that have some greying in traffic areas, floors with some cosmetic flaws, e.g., paint spatters, and floors with waxy surfaces. Floors with severe wear include floors that have definite visible wear marks, compression marks from furniture and various other flaws such as staining from biological fluids. Regardless of the category, the wear may be the result of water damage.

For floors with minor wear, the "minor aggressive strategy" can be used. For floors with medium wear, the "medium aggressive strategy" can be used. For floors with severe wear, the "severe aggressive strategy" can be used. Details of these strategies are described below, but in general, the buffer unit is plugged in as close to the entry point as possible. Setup begins at the furthest point from entry, working backwards across the grain of the floor or with the grain of the floor, and backwards to the entry point.

Figure 13:
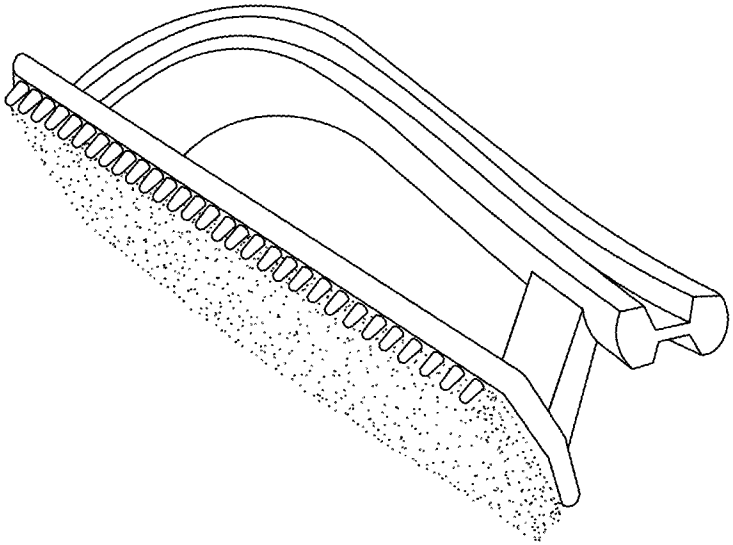
FIG. 13 illustrates a hand-held scrubber.

For the minor aggressive strategy, a 16-inch maroon scrubbing pad is used. To begin cleaning, the user lowers the handle and disperses fluid while working to the right because the buffer rotates clockwise. While the floor is wet and dirt is loose, the user stops the buffer, lifts up the handle and locks it. Then the user slides a 320-220 grit 16-inch sanding disc under the pad. The disc is worked over the wet area until the disc becomes clogged, then the screen is flipped so the other side can be used. The process continues until the area that has been wet has dried out completely from screening, but before any dust is generated. The process is repeated on each section of the floor, covering about ten square feet at a time. To work the edges along the floor, a plastic hand held scrubber (shown in FIG. 13) outfitted with a maroon pad and sand disc can be used to feather the edges from the machine to the edge of the floor. The sanding discs can be rotated as they become clogged.

Figure 16:
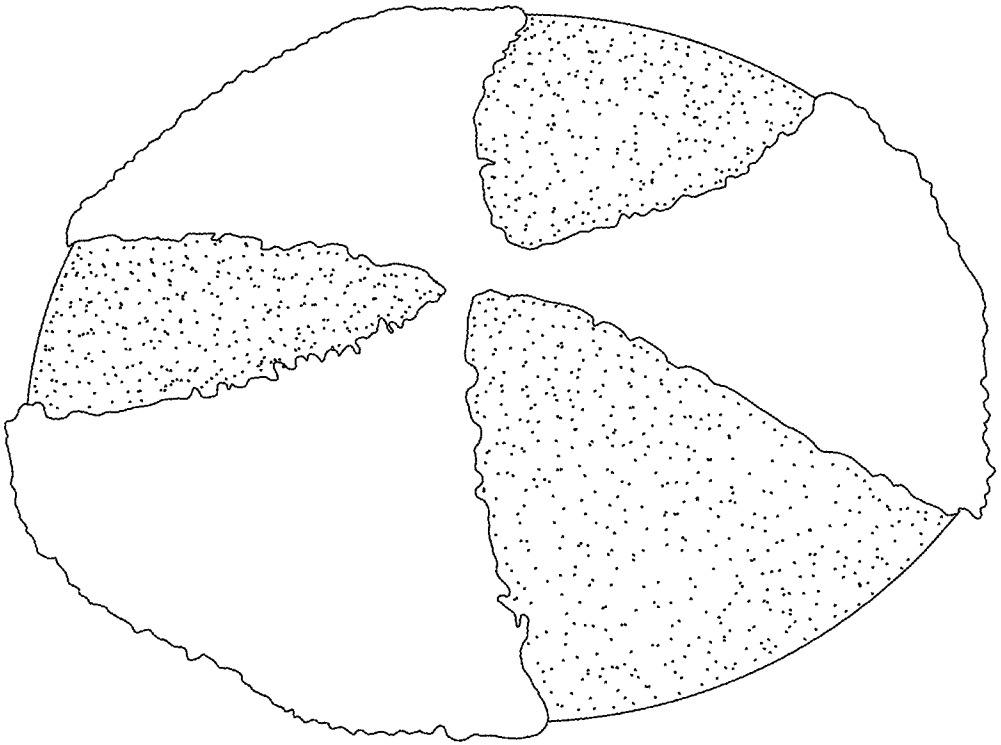
FIG. 16 illustrates a maroon pad and microfiber combo.

If the floor is very dirty and significant quantities of dirty liquid remain on the floor, a micro-fiber cloth on a pole can be used to remove the excess dirt. Maroon pads with attached micro-fiber pads (shown in FIG. 16) can be used on larger areas in place of hand-mopping.

Once the entire floor has been cleaned adequately back to the entry point, a coating can be applied. It is not necessary to neutralize or rinse the solution. In some embodiments, remaining dirt may be removed with a vacuum-cleaner, a microfiber pad (see FIG. 16), a sticky or a tack rag. In some embodiments, the dirt can be removed with an open coat aluminum oxide paper can be used in order to reduce particulates and the need for vacuuming prior to coating.

The medium aggressive strategy is generally similar to that described above for the minor aggressive strategy. However, since this strategy is used for floors that show some greying, cosmetic flaws or marks, the sanding process relies on coarse scrub pads and 80, 120-220 grit sanding screens.

The severe aggressive strategy is generally similar to that described above for the medium aggressive strategy. However, since this strategy is used for floors that show severe greying, compression marks and staining, the sanding process relies on coarse scrub pads and 60-80 grit sanding screens. To insure an even result, a vacuum and hose connected to a HPA filter vacuum are then used to perform a screen sand operation to erase any visible swirls left by heavy grits of sanding screen.

Optionally, for floors that are worn, raw or scratched, the aqueous detergent solution and the VM & P naphtha can be combined with a wax in proportions described above. Such compositions are useful for cleaning and sealing the wood grain without grain raise or significant greying. The solution can be applied as above either by hand or by microfiber mopping.

In some embodiments, for example, for waxy and paint spattered floors, one or more micro blade disks can be sewn onto a 16-inch maroon pad as shown in FIG. 14. The micro-blade disk/pad apparatus can be applied to the floor following the application of the compositions. The micro-blade disk/pad apparatus generates a wax "slurry" which can then be removed before the sanding screens are used.

The methods and compositions may be also used to remove stains from wooden surfaces. Some floor stains may result from contact with carpets or carpet padding. Other exemplary stains on floors and other surfaces include stains that result from paint, grease, oil, mold, food or beverages, e.g., coffee, tea alcoholic beverages. Other stains on flooring, furniture or cabinetry may result from contact with biological fluids, for example, urine, stool, blood or vomit. The source of the biological fluids may be animals or humans. Urine contains uric acid crystals and other metabolites that produce dark, blackened stains in wood. The method of the invention can be used for stain removal as described above except that in some embodiments, the aqueous detergent solution and the VM & P naphtha are combined in a 1:1 ratio. In some embodiments, the aqueous detergent solution/VM & P naphtha mixture can be combined with a wax.

In some embodiments, the compositions of the invention may be used to prepare floor finishes where the chemical window for re-coating has lapsed and which would generally require screening before coating, for example, on clean, unworn and undamaged floor finishes. For these floors, the compositions can be applied with either a swing buffer outfitted with a standard maroon pad or a battery powered scrubber. No sanding is necessary and the floors can be coated immediately after treatment.

For vertical surfaces such as risers, railings, furniture and cabinetry, the compositions can be decanted into a container such as a small squirt bottle. The solution is applied to a microfiber pad, which is then used to scrub a small area. The area is then sanded with the appropriate sanding screen, keeping a micro fiber pad over top of the screen while sanding. In some embodiments, light open coat sandpaper can be used. As the screens become clogged, they are replaced. If the surface dries, the solution is reapplied and screening continued. For particularly soiled surfaces, a hand held plastic scrubber outfitted with a maroon pad and appropriate screen can be employed. The finishing steps are the same as described above.

Regardless of the methods used, appropriate clean-up procedures should be followed once the sanding step is completed. Used maroon pads and micro fibers can be re-soaked in water, rinsed, and left to dry. Reused sanding screens and scrubbers that are not salvageable should be disposed of in the proper manner.

Following the application of the solution and sanding, the floor can be coated with a surface finish or coating. Any coating known in the art may be used. The choice of a coating will depend on many factors including the composition of the surface, the location of the surface, the cost of the coating and the aesthetic properties of the coating. Exemplary coatings include, urethanes e.g., polyurethane, oil-modified urethanes, moisture-cured urethanes, water-based urethanes; conversion-varnish sealers (Swedish Finishes); penetrating sealers, e.g., penetrating oil sealers made from tung or linseed oil and other additives; waxes, such as paste wax; varnishes, e.g., vinyl-alkyd varnishes or natural varnishes made from vegetable oils; shellacs, e.g, dewaxed shellac; and lacquers. The coating can be applied using any method known in the art.

The different strategies described above also can include different finishing techniques. For the minor aggressive strategy that is used for floors that have only minor wear, any VOC (Volatile Organic Compound) and/or LEEDS compliant polyurethane can be used. The polyurethane can be applied using any method known in the art. Useful application methods and standards are described in the National Wood Flooring Association (NWFA) guidelines. For floors in this category, one coat may be sufficient, although for some floors, including those in the categories below, the coating may be applied two, three, four or more times. Air circulation can be employed when necessary in order to promote rapid drying of the coating, sealing the wood without grain rise and curing of the finish.

For the medium aggressive strategy that is used on floors that have a moderate degree of wear, additional finishing techniques may be used. In areas that had been grayed and which may appear raw after sanding, a color tint mixture of a fast drying stain can be employed to feather out the worn or previously grayed areas. Color tinting combinations will vary depending on the floor finish, previous exposure to ultra-violet light and the general patina of the wood. Premixed colorant ratios can be readily formulated with commercially available technologies. Depending on the amount of raw wood and how it was sealed, there may be a need to lightly screen, vacuum and tack before the next finish coat is applied. The finish system can then be applied as described above. For floors that have suffered the most extensive wear and that have been prepared using the severe aggressive strategy, color tinting and staining as described above may also be employed. For these floors, it may be necessary to apply at least three coats of such stains.

The coating step can be carried out immediately following the completion of the sanding step. Alternatively, the coating step can be separated in time from the sanding step by 2, 4, 6, 8, 10, 12, 24, 36, 48 or more hours. For surfaces with minor to moderate wear that require the least aggressive and medium aggressive strategies, the steps of applying the solution, sanding and coating can typically accomplished in one workday cycle. For surfaces with more severe wear that require the severe aggressive strategy, two to three days may be needed.

The method can be applied to any kind of wooden surface, including, for example, without limitation, floors, furniture, cabinetry, and fixtures. Exemplary floors include solid wood floors, e.g., hardwoods such as oak, maple, hickory, teak, fruitwood, birch or softwoods such as pine; bamboo floors; engineered floors or laminates, e.g., wood flooring composed of two or more layers of wood. The methods can be applied to any kind of wooden furniture or other household objects, including for example, chairs, desks, tables, sofas, love seats, benches, beds, stools, armoires, chests, dressers, display cabinets, clocks, credenzas, entertainment centers, arm rails, banisters, couches, beds, carts, pianos, statues and other art, mirrors, racks, or light fixtures. The methods can also be applied to any kind of wooden fixture, for example, cabinets and shelving, drawers, counter tops, doors, window frames and ledges, railings, or banisters. The wooden flooring and fixtures may be located in any setting, for example, in buildings, boats, or aircraft.

The compositions and methods described herein can be used on wooden surfaces in a wide range of settings including private homes, commercial, institutional and industrial settings. Exemplary settings include but are not limited to retail facilities, industrial/manufacturing facilities; office facilities; health care facilities; hotel/restaurant/entertainment facilities, educational facilities (e.g. schools and day care centers for children and seniors; recreational facilities (e.g., arenas, coliseums, resorts, halls, stadiums, cruise lines, arcades, convention centers, museums, theaters, clubs; family entertainment complexes (e.g., indoor and/or outdoor), marinas, parks); food service facilities; governmental facilities; and public transportation facilities (e.g., airports, airlines, cabs, buses, trains, subways, boats, ports, and their associated properties).

Exemplary results of the methods described above are described in the examples below and illustrated in FIGS. 1-16.

EXAMPLES

Example 1: Engineered Bamboo Floors

Figure 1A:
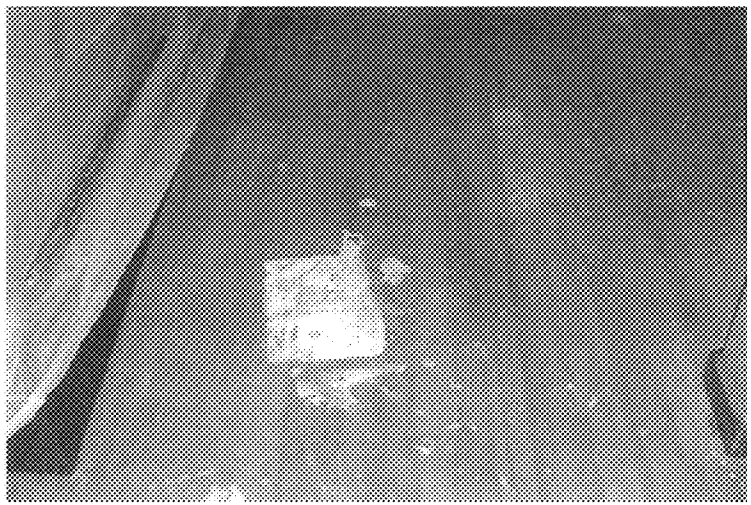
FIG. 1*a* illustrates an engineered bamboo floor before treatment with the methods of the invention.

FIG. 1*a* illustrates an engineered bamboo floor before treatment with the methods of the invention. The floor was heavily marked with four different oil paint drippings. FIG. 1*b* illustrates the floor in FIG. 1*a* after application of the solution, sanding and coating.

Example 2: Stained Red Oak

Figure 2B:
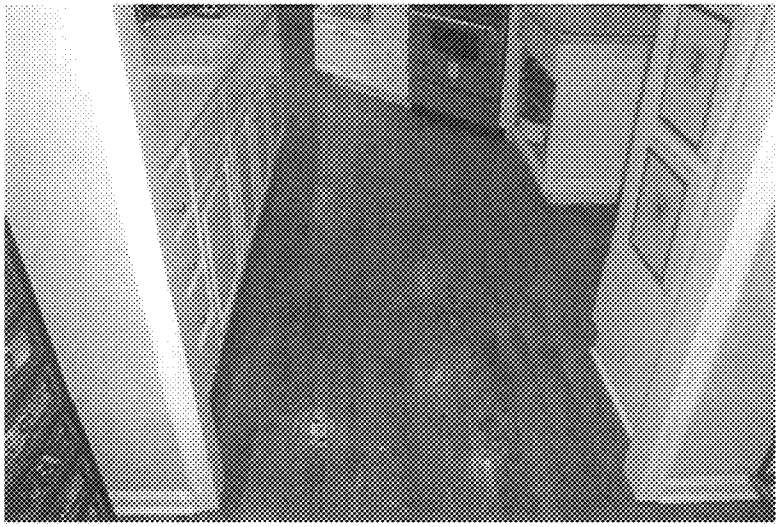
FIG. 2*b* illustrates the floor in FIG. 2*a* after treatment with the methods of invention.
Figure 2A:
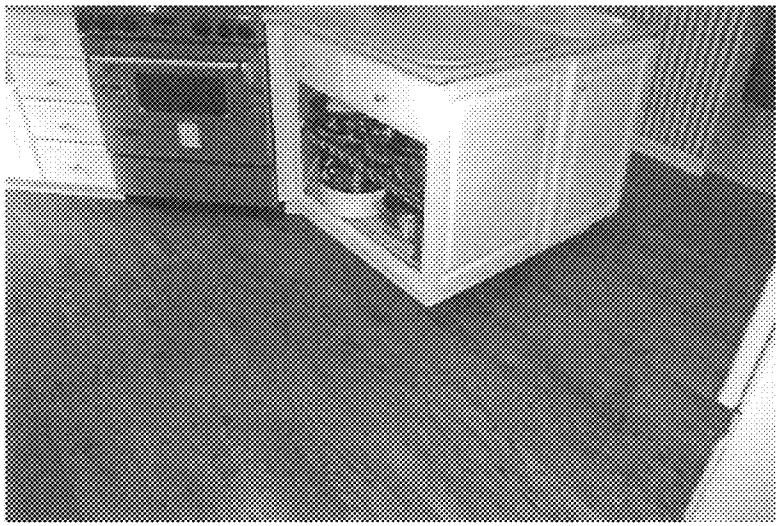
FIG. 2*a* illustrates stained red oak flooring before treatment with the methods of the invention.

FIG. 2*a* illustrates a fifteen year old urethane finish on stained red oak flooring before treatment with the methods of the invention. FIG. 2*b* illustrates the floor in FIG. 2*a* after application of the solution, sanding and coating.

Example 3: Stair Treads

Figure 3B:
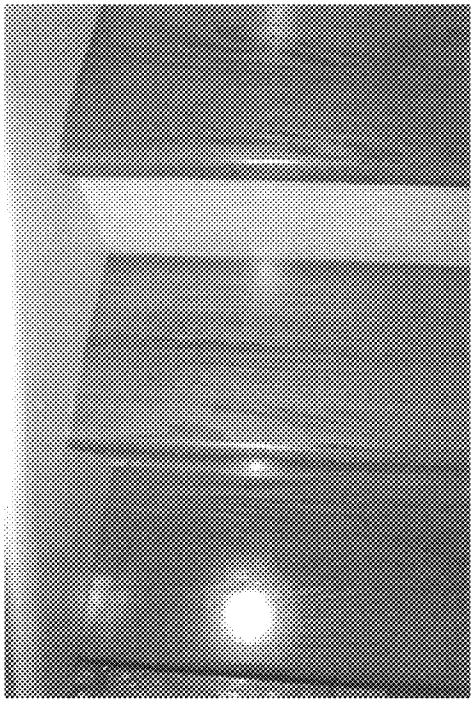
FIG. 3*b* illustrates the stair treads in FIG. 3*a* after treatment with the methods of invention.
Figure 3A:
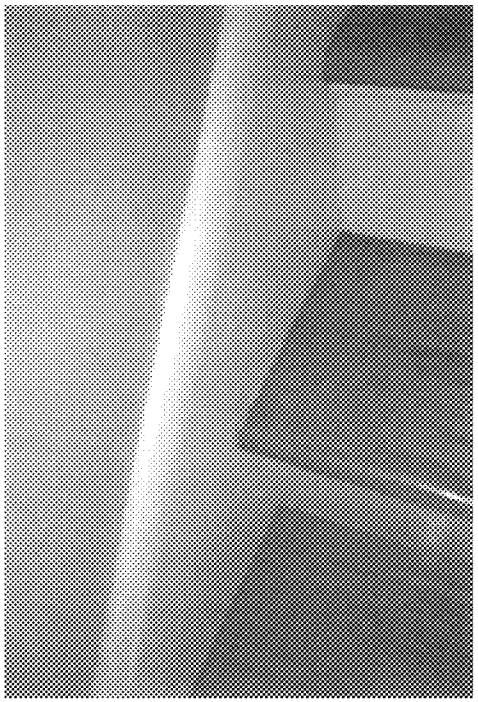
FIG. 3*a* illustrates oak stair treads before treatment with the methods of the invention.

FIG. 3*a* illustrates oak stair treads before treatment with the methods of the invention. FIG. 3*b* illustrates the stair treads in FIG. 3*a* after application of the solution, sanding and coating.

Example 4: Bamboo Flooring

Figure 4B:
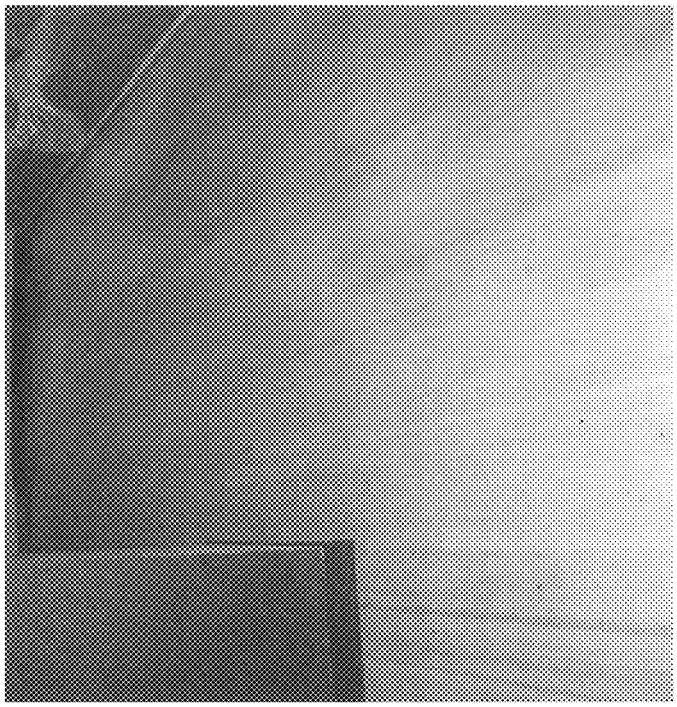
FIG. 4*b* illustrates the floor in FIG. 4*a* after treatment with the methods of invention.
Figure 4A:
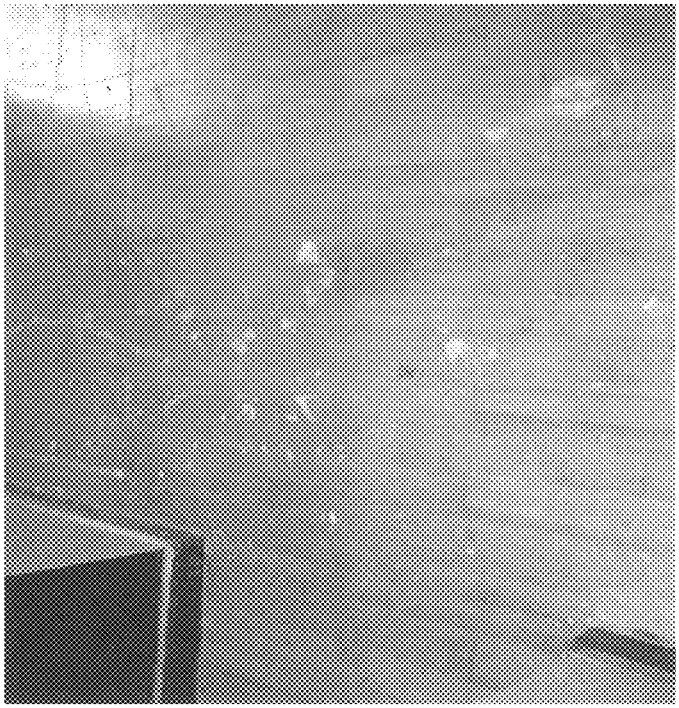
FIG. 4*a* illustrates a bamboo floor before treatment with the methods of the invention.

FIG. 4*a* illustrates a bamboo floor before treatment with the methods of the invention. FIG. 4*b* illustrates the floor in FIG. 4*a* after application of the solution, sanding and coating.

Example 5: Flooring with Worn-Off and Greying Finish

Figure 5B:
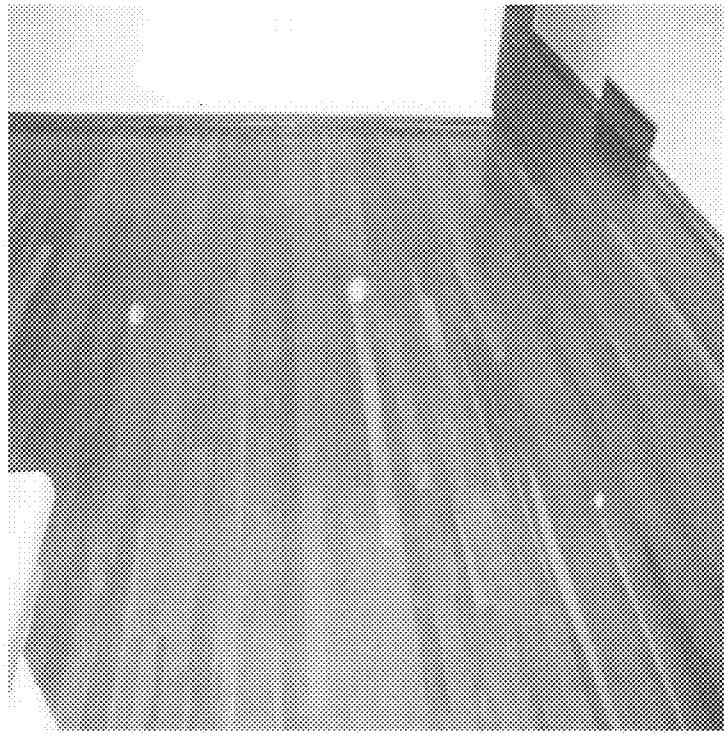
FIG. 5*b* illustrates the floor in FIG. 5*a* after treatment with the methods of invention.
Figure 5A:
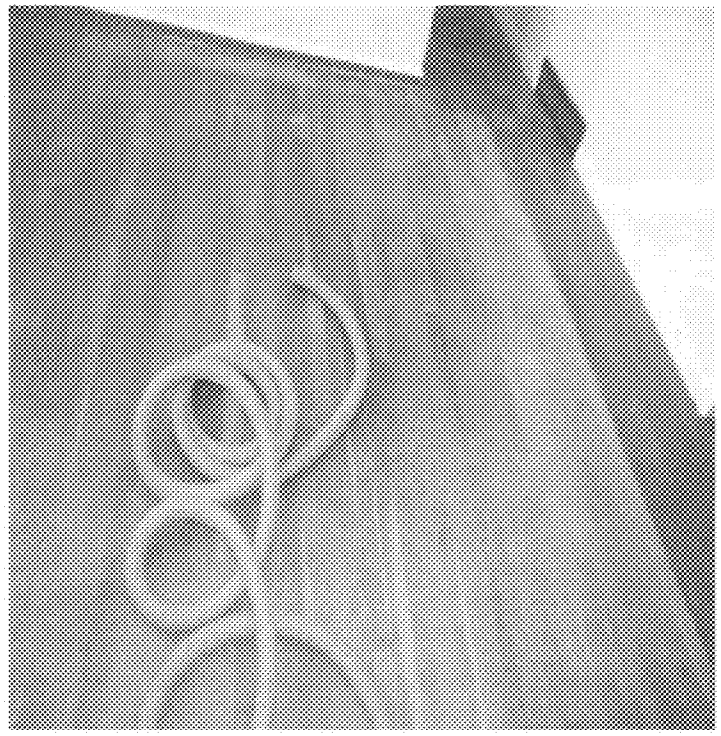
FIG. 5*a* illustrates a floor before treatment with the methods of the invention.

FIG. 5*a* illustrates a floor before treatment with the methods of the invention. Note that the floor in FIG. 5*a* included large areas where the original finish has been either worn off or has acquired a greyish hue. FIG. 5*b* illustrates the floor in FIG. 5*a* after application of the solution, sanding and coating. As shown in FIG. 5*b*, the worn and greyish areas were restored essentially to their unworn condition following treatment with the methods of invention.

Example 6: Heavily Worn Flooring

Figure 6A:
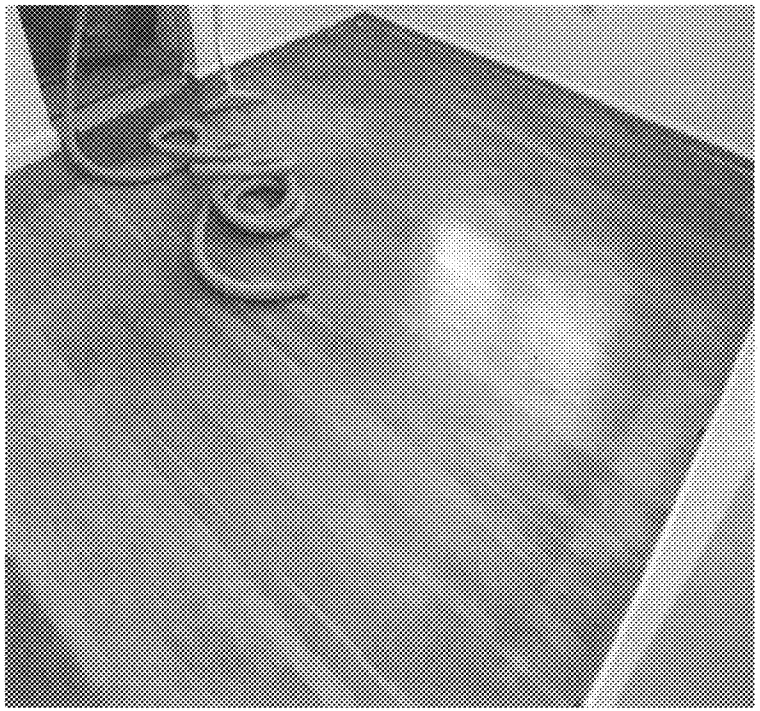
FIG. 6*a* illustrates a floor before treatment with the methods of the invention.
Figure 6B:
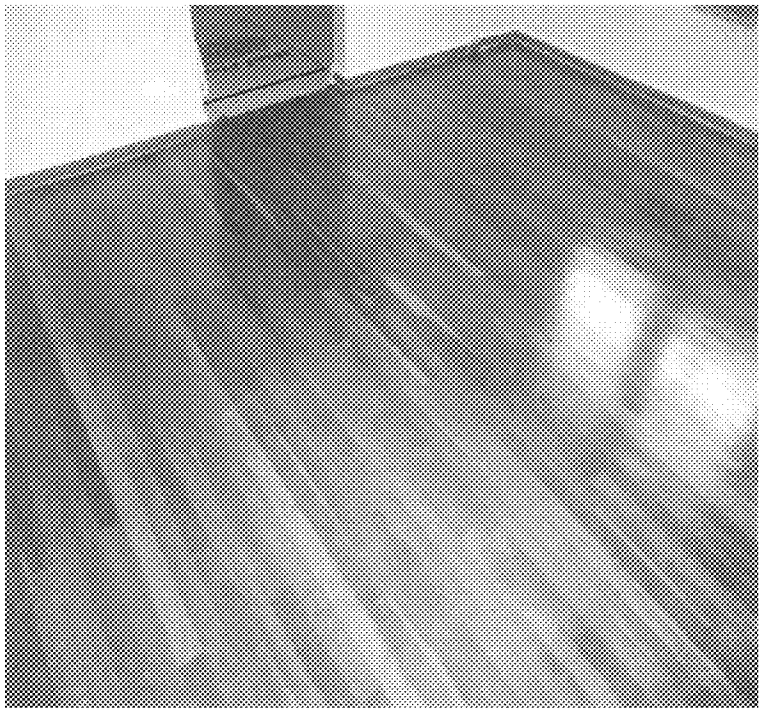
FIG. 6*b* illustrates the floor in FIG. 6*a* after treatment with the methods of invention.

FIG. 6*a* illustrates a floor before treatment with the methods of the invention. Note the wear patterns in the heavily trafficked areas around the perimeter of the room. FIG. 6*b* illustrates the floor in FIG. 6*a* after application of the solution, sanding and coating. As shown in FIG. 6*b*, the wear patterns were removed following treatment with the methods of invention.

Example 7: Furniture

Figure 8:
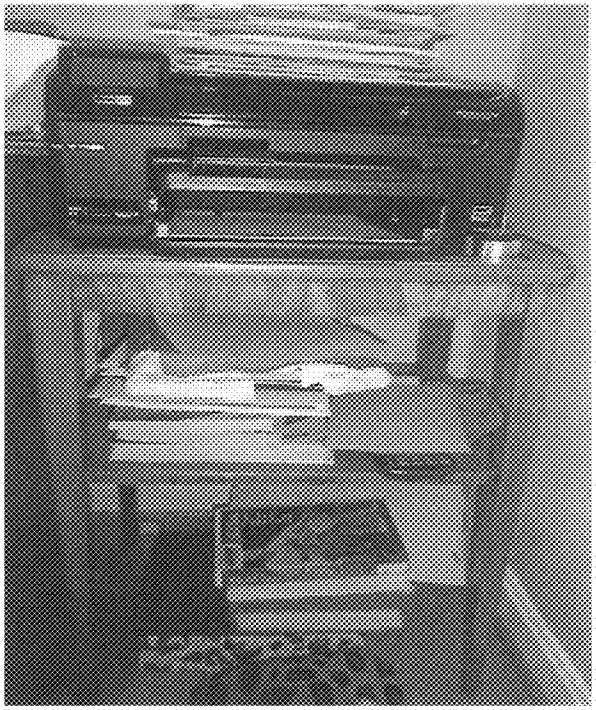
FIG. 8 illustrates an end table after treatment with the methods of invention.
Figure 7:
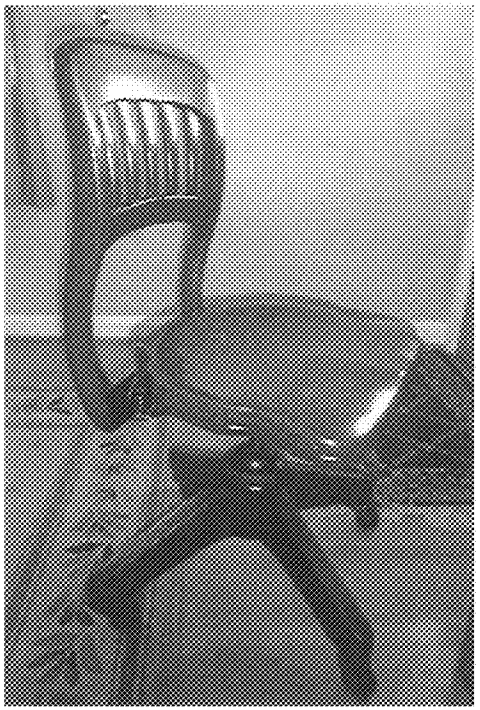
FIG. 7 illustrates a computer chair after treatment with the methods of invention.

FIG. 7 illustrates a computer chair after treatment with the methods of invention. FIG. 8 illustrates an end table after treatment with the methods of invention.

Example 8: Heavily Worn Flooring

Figure 9B:
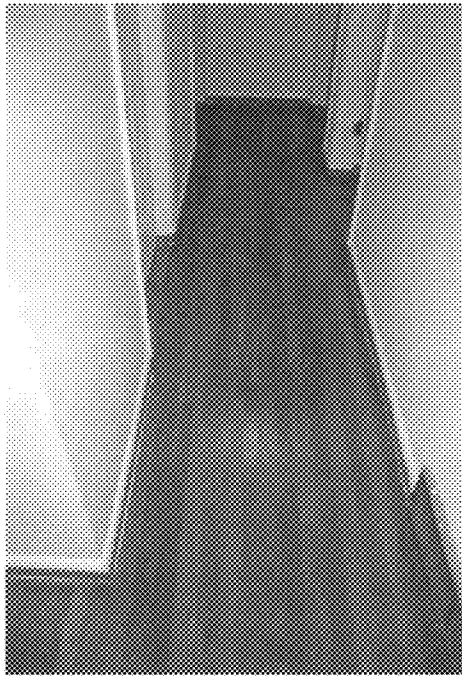
FIG. 9*b* illustrates the hallway floor in FIG. 9*a* after treatment with the methods of invention.
Figure 9A:
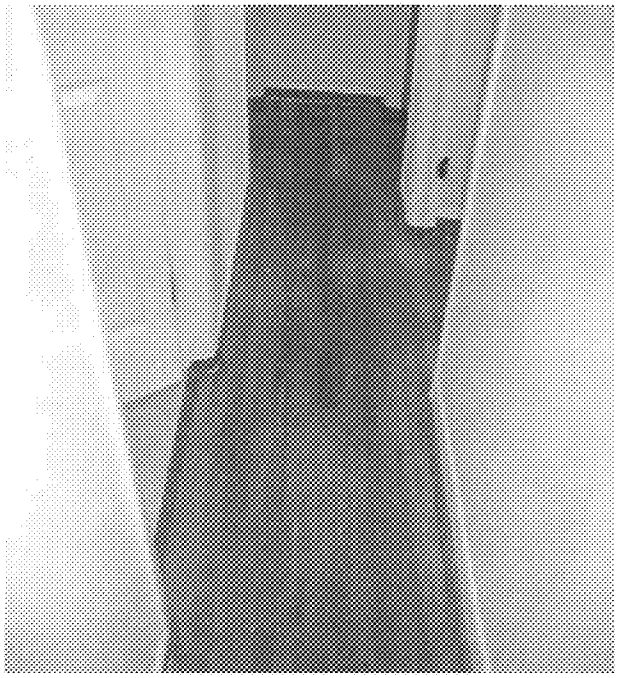
FIG. 9*a* illustrates a hallway floor before treatment with the methods of the invention.

FIG. 9*a* illustrates a hallway floor before treatment with the methods of the invention. Note the wear patterns along the length of the hallway. FIG. 9*b* illustrates the hallway floor in FIG. 9*a* after application of the solution, sanding and coating. As shown in FIG. 9*b*, the wear patterns were removed following treatment with the methods of invention.

Example 9: Wafer-Thin Flooring

Figure 10B:
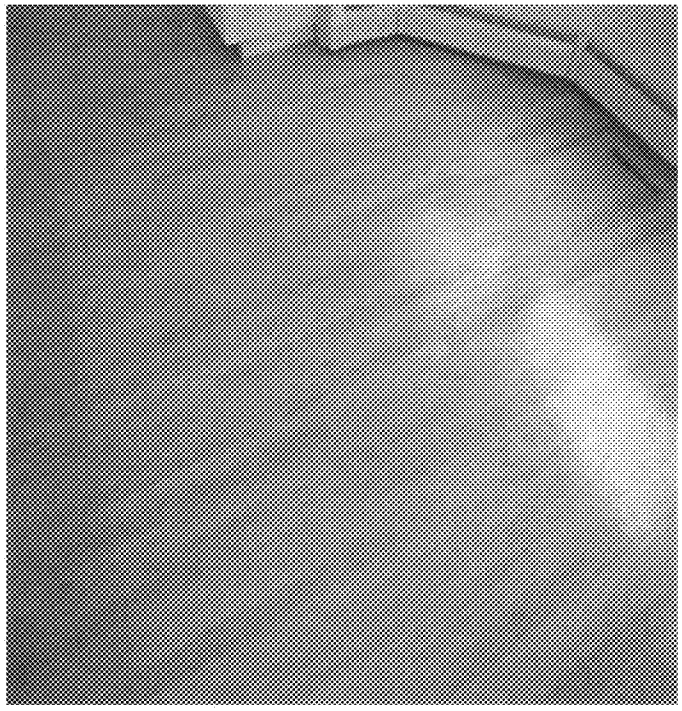
FIG. 10*b* illustrates the floor in FIG. 10*a* after treatment with the methods of invention.
Figure 10A:
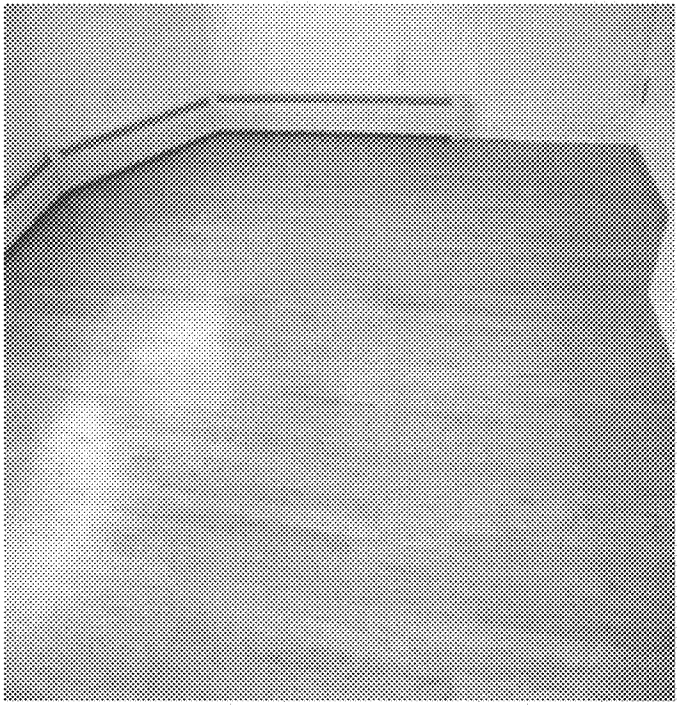
FIG. 10*a* illustrates a floor before treatment with the methods of the invention.

FIG. 10*a* illustrates a wafer-thin floor with severe greying before treatment with the methods of the invention. FIG. 10*b* illustrates the floor in FIG. 10*a* after application of the solution, sanding and coating. As shown in FIG. 10*b*, the greyish areas were restored essentially to their unworn condition following treatment with the methods of invention.

Example 10: Flooring with Compression Marks

Figure 11:
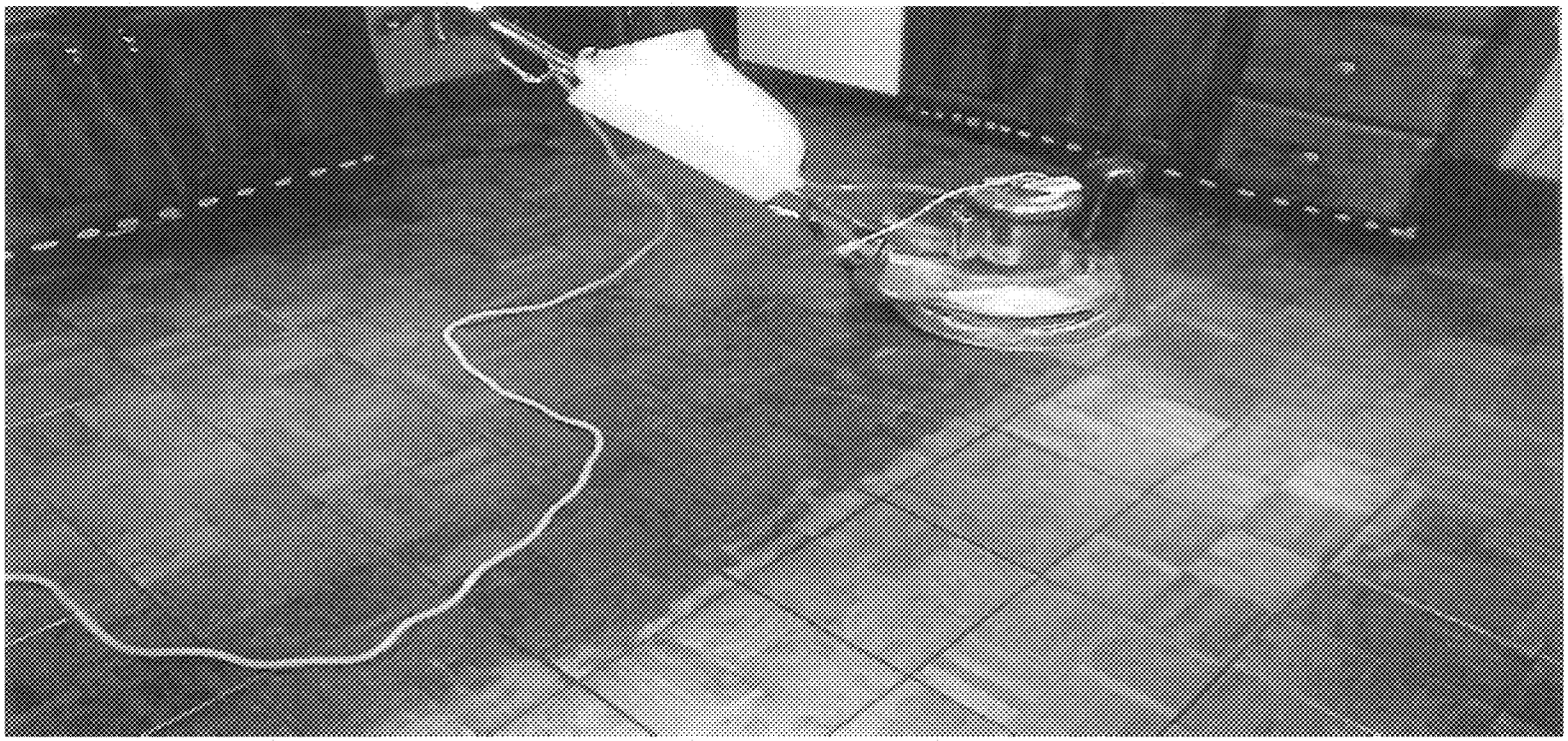
FIG. 11 illustrates the cleaning, scrubbing and wet sanding steps of the methods of invention.
Figure 12:
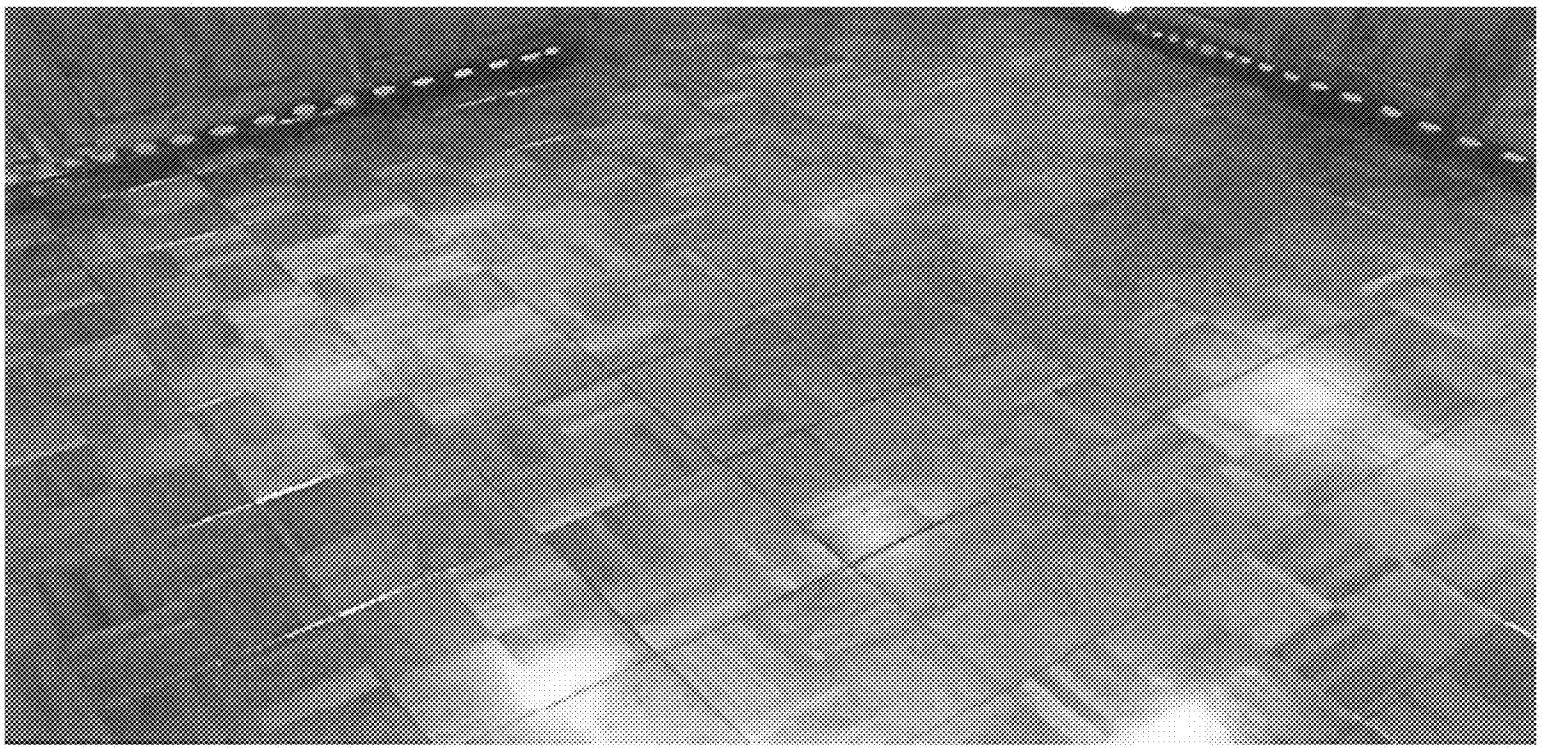
FIG. 12 illustrates the finishing step of the methods of invention.

FIG. 11 illustrates the a floor with compression marks that is in the process of the cleaning scrubbing and wet sanding methods of the invention. For this example on a parquet floor, the existing finish was cleaned scrubbed and wet sanded. An abrasive scrub was performed. Some areas were sanded by hand, others were machine-sanded. The sanding removed compression marks left by the refrigerator and furniture. Following the scrubbing and sanding steps, the surface was immediately ready for finishing. FIG. 12 illustrates the floor shown in FIG. 11 following the finishing step. The finishing step included four coats of polyurethane.

It is to be understood that the present invention is by no means limited only to the particular constructions herein disclosed and shown in the drawings, but also comprises any modifications or equivalents within the scope of the claims.

What is claimed is:

1. A method of resurfacing a damaged wooden floor, the method consisting of:

a) applying a composition comprising an aqueous detergent solution and varnish makers' and painters' (VM & P) naphtha, and a wax, to the damaged floor; wherein the aqueous detergent solution comprises one or more glycol ethers, wherein the damage comprises a graying finish, wear marks, compression marks, wear down to raw wood, stains, or water damage; and b) wet sanding the floor in the presence of the composition comprising an aqueous detergent solution and varnish makers' and painters' (VM & P) naphtha, and a wax for a time sufficient to substantially dry the sanded floor without generating dust, thereby sealing the wood grain without grain raise;

c) applying a coating to the sanded floor, wherein the coating comprises a polyurethane.

2. The method of claim 1, wherein the aqueous detergent solution further comprises one or more surfactants and emulsifiers.

3. The method of claim 1, wherein the aqueous detergent solution and varnish makers' and painters' (VM & P) naphtha are combined to form a mixture in a volume ratio of about 10:1 to about 1:1.

4. The method of claim 3, wherein the aqueous detergent solution and varnish makers' and painters' (VM & P) naphtha mixture is combined with the wax in a volume ratio of about 1:1 to about 1:10.

5. The method of claim 1, wherein the sanding step comprises sanding with a 60-320 grit sanding disc.

6. The method of claim 5, wherein the grit sanding disc is a 220-320 grit sanding disc.

7. The method of claim 5, wherein the grit sanding disc is a 80-220 grit sanding disc.

8. The method of claim 5, wherein the grit sanding disc is a 60-80 grit sanding disc.

9. The method of claim 1, wherein the applying and the sanding are performed simultaneously.

10. The method of claim 1, wherein the coating step is repeated two or more times.

11. The method of claim 1, further comprising identifying a surface in need of resurfacing.

12. The method of claim 1, wherein the floor is a hardwood floor, an engineered floor or a bamboo floor.

13. The method of claim 1, wherein the wooden surface comprises flooring.

14. The method of claim 1, wherein the coating step is carried out immediately following completion of the sanding step.

15. The method of claim 1, further comprising removing remaining liquid or dirt from the sanded floor of step b.

16. A method of resurfacing a damaged wooden floor, the method consisting essentially of:

a) applying a composition comprising an aqueous detergent solution and varnish makers' and painters' (VM & P) naphtha, and a wax, to the damaged floor; wherein the aqueous detergent solution comprises one or more glycol ethers, wherein the damage comprises a graying finish, wear marks, compression marks, wear down to raw wood, stains, or water damage; and b) wet sanding the floor in the presence of the composition comprising an aqueous detergent solution and varnish makers' and painters' (VM & P) naphtha, and a wax for a time sufficient to substantially dry the sanded floor without generating dust, thereby sealing the wood grain without grain raise;

c) applying a coating to the sanded floor, wherein the coating comprises a polyurethane.

* * * * *